US006578802B1

(12) United States Patent
Thier

(10) Patent No.: US 6,578,802 B1
(45) Date of Patent: Jun. 17, 2003

(54) WATER COOLER SUPPORT DEVICE

(76) Inventor: Steven E. Thier, 320-37th St., Lindenhurst, NY (US) 11757

( * ) Notice: Subject to any disclaimer, the term of this patent is extended or adjusted under 35 U.S.C. 154(b) by 28 days.

(21) Appl. No.: 09/887,239

(22) Filed: Jun. 22, 2001

(51) Int. Cl.[7] ..... A47G 23/02
(52) U.S. Cl. ..... 248/151; 248/146
(58) Field of Search ..... 248/150, 146, 248/151, 163.1; 217/36, 52

(56) References Cited

U.S. PATENT DOCUMENTS

| | | | | | |
|---|---|---|---|---|---|
| 861,093 | A | * | 7/1907 | Cordley | 248/150 |
| 1,001,717 | A | * | 8/1911 | Weatherby | 217/52 |
| 1,023,181 | A | * | 4/1912 | Uhl | 248/150 |
| 1,154,906 | A | * | 9/1915 | Berkley | 217/36 |
| 1,342,951 | A | * | 6/1920 | Gagne | 248/151 |
| 2,490,369 | A | | 12/1949 | Neuwirth | 248/150 |
| 2,573,428 | A | * | 10/1951 | Gardner | 217/52 |
| 4,620,527 | A | * | 11/1986 | Adams, Jr. | 248/151 |
| 4,664,349 | A | | 5/1987 | Johansen et al. | 248/150 |
| D310,426 | S | | 9/1990 | Rook | D26/138 |
| 5,123,720 | A | | 6/1992 | Blomster et al. | 312/263 |
| 5,184,476 | A | | 2/1993 | Desrosiers et al. | 62/389 |
| 5,784,972 | A | | 7/1998 | Emalfarb et al. | 108/156 |
| 6,349,906 | B1 | * | 2/2002 | Anderson | 248/146 |

* cited by examiner

*Primary Examiner*—Kimberly Wood
*Assistant Examiner*—Gwendolyn Baxter

(57) ABSTRACT

A water cooler support device for holding a water cooler in an easily accessible manner. The water cooler support device includes a bottom support having a top side, a bottom side and a peripheral edge extending between the top and bottom sides. The top side has a generally circle shape. A peripheral lip is integral to and extends upwardly from the peripheral edge of the bottom support. The peripheral lip has a notch therein extending from an upper edge of the peripheral lip down to the bottom support for receiving the nozzle of the water cooler. Each of a plurality of legs is attached to and extends downward from the bottom side of the bottom support. The legs are spaced from each other. Each of the legs is angled outwardly with respect to each other.

1 Claim, 3 Drawing Sheets

WATER COOLER SUPPORT DEVICE

BACKGROUND OF THE INVENTION

1. Field of the Invention

The present invention relates to support stands and more particularly pertains to a new water cooler support device for holding a water cooler in an easily accessible manner.

2. Description of the Prior Art

The use of support stands is known in the prior art. More specifically, support stands heretofore devised and utilized are known to consist basically of familiar, expected and obvious structural configurations, notwithstanding the myriad of designs encompassed by the crowded prior art which have been developed for the fulfillment of countless objectives and requirements.

Known prior art includes U.S. Pat. Nos. 5,785,972; 5,184,476; 4,664,349; 5,123,720; 2,490,369; U.S. Des. Pat. No. 310,426.

While these devices fulfill their respective, particular objectives and requirements, the aforementioned patents do not disclose a new water cooler support device. The inventive device includes a bottom support having a top side, a bottom side and a peripheral edge extending between the top and bottom sides. The top side has a generally circle shape. A peripheral lip is integral to and extends upwardly from the peripheral edge of the bottom support. The peripheral lip has a notch therein extending from an upper edge of the peripheral lip down to the bottom support for receiving the nozzle of the water cooler. Each of a plurality of legs is attached to and extends downward from the bottom side of the bottom support. The legs are spaced from each other. Each of the legs is angled outwardly with respect to each other.

In these respects, the water cooler support device according to the present invention substantially departs from the conventional concepts and designs of the prior art, and in so doing provides an apparatus primarily developed for the purpose of holding a water cooler in an easily accessible manner.

SUMMARY OF THE INVENTION

In view of the foregoing disadvantages inherent in the known types of support stands now present in the prior art, the present invention provides a new water cooler support device construction wherein the same can be utilized for holding a water cooler in an easily accessible manner.

The general purpose of the present invention, which will be described subsequently in greater detail, is to provide a new water cooler support device apparatus and method which has many of the advantages of the support stands mentioned heretofore and many novel features that result in a new water cooler support device which is not anticipated, rendered obvious, suggested, or even implied by any of the prior art support stands, either alone or in any combination thereof.

To attain this, the present invention generally comprises a bottom support having a top side, a bottom side and a peripheral edge extending between the top and bottom sides. The top side has a generally circle shape. A peripheral lip is integral to and extends upwardly from the peripheral edge of the bottom support. The peripheral lip has a notch therein extending from an upper edge of the peripheral lip down to the bottom support for receiving the nozzle of the water cooler. Each of a plurality of legs is attached to and extends downward from the bottom side of the bottom support. The legs are spaced from each other. Each of the legs is angled outwardly with respect to each other.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new water cooler support device apparatus and method which has many of the advantages of the support stands mentioned heretofore and many novel features that result in a new water cooler support device which is not anticipated, rendered obvious, suggested, or even implied by any of the prior art support stands, either alone or in any combination thereof.

It is another object of the present invention to provide a new water cooler support device which may be easily and efficiently manufactured and marketed.

It is a further object of the present invention to provide a new water cooler support device which is of a durable and reliable construction.

An even further object of the present invention is to provide a new water cooler support device which is susceptible of a low cost of manufacture with regard to both materials and labor, and which accordingly is then susceptible of low prices of sale to the consuming public, thereby making such water cooler support device economically available to the buying public.

Still yet another object of the present invention is to provide a new water cooler support device which provides in the apparatuses and methods of the prior art some of the advantages thereof, while simultaneously overcoming some of the disadvantages normally associated therewith.

Still another object of the present invention is to provide a new water cooler support device for holding a water cooler in an easily accessible manner.

Yet another object of the present invention is to provide a new water cooler support device which includes a bottom support having a top side, a bottom side and a peripheral edge extending between the top and bottom sides. The top side has a generally circle shape. A peripheral lip is integral to and extends upwardly from the peripheral edge of the bottom support. The peripheral lip has a notch therein extending from an upper edge of the peripheral lip down to the bottom support for receiving the nozzle of the water cooler. Each of a plurality of legs is attached to and extends downward from the bottom side of the bottom support. The legs are spaced from each other. Each of the legs is angled outwardly with respect to each other.

Still yet another object of the present invention is to provide a new water cooler support device that is adapted for holding insulated devices which store water or other liquids above the ground for easy access at events such as youth sports.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
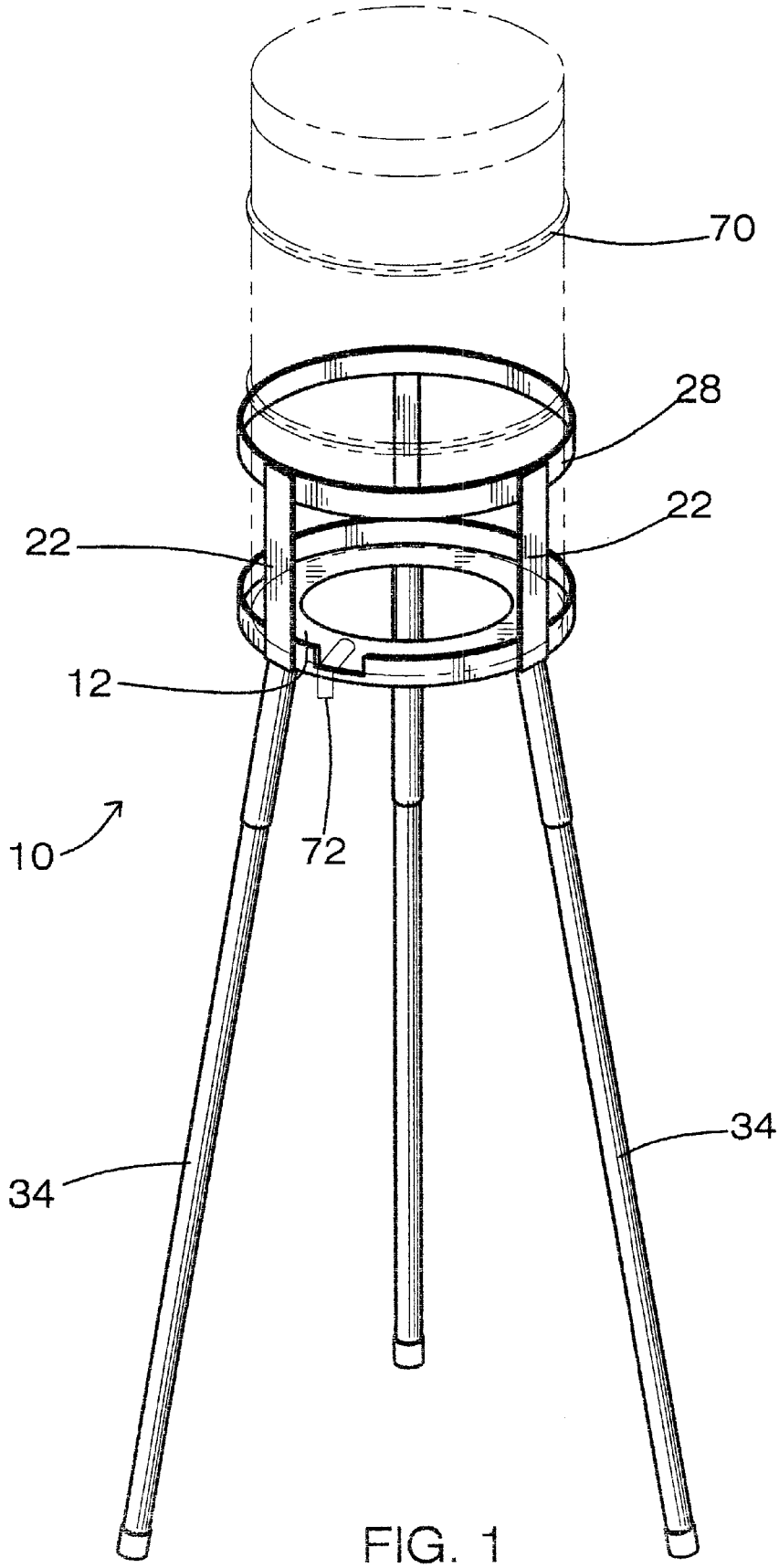
FIG. 1 is a schematic perspective view of a new water cooler support device according to the present invention.
Figure 2:
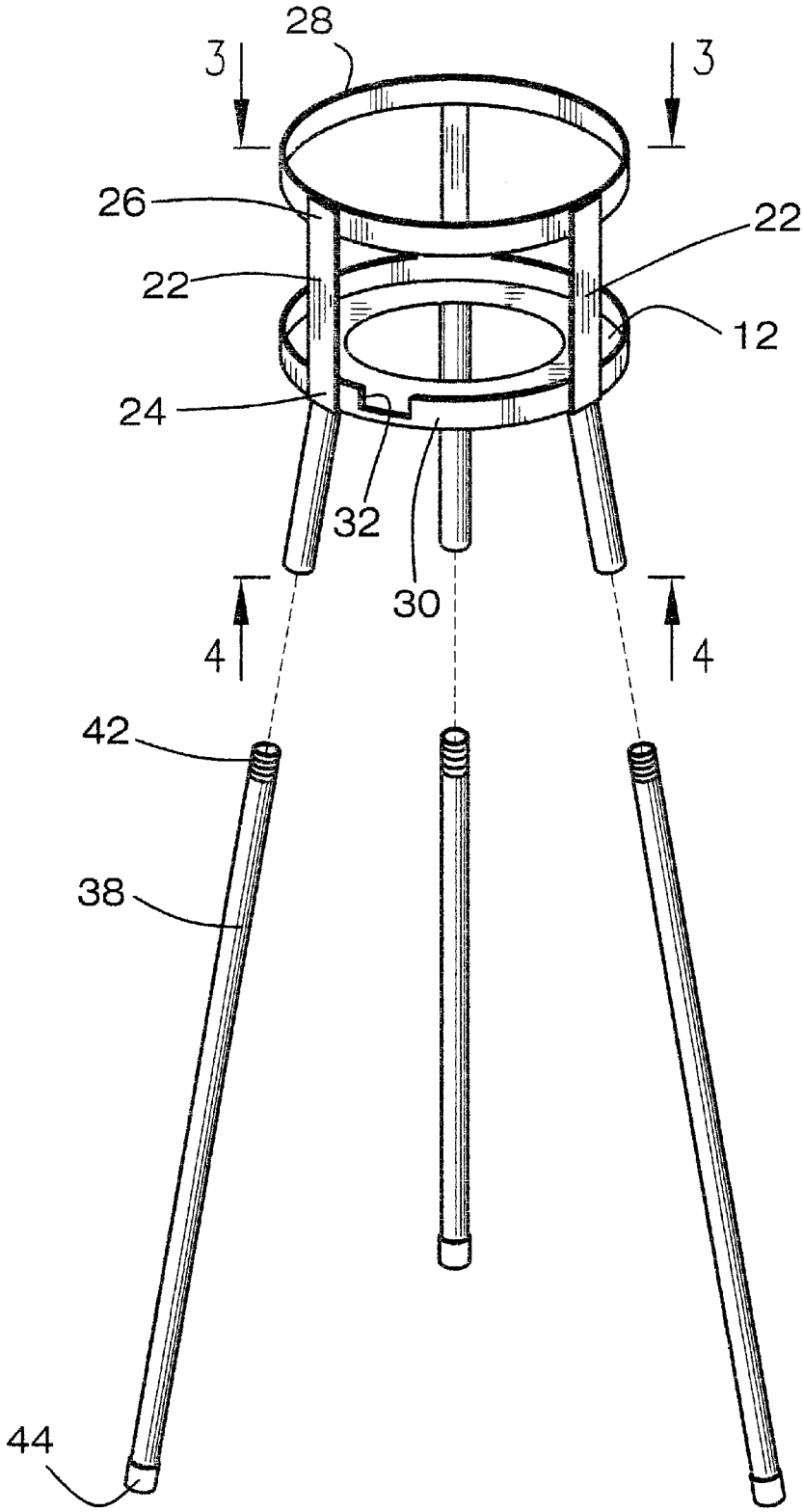
FIG. 2 is a schematic perspective view of the present invention.
Figure 3:
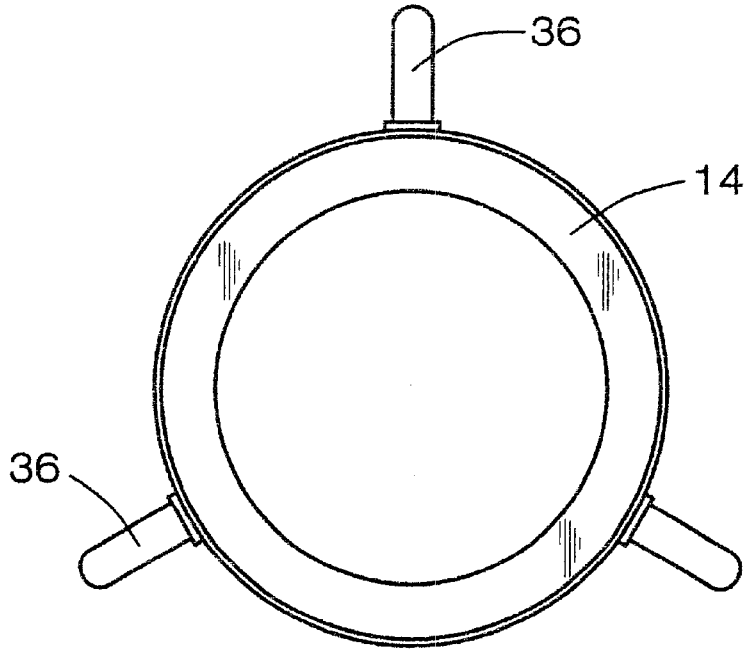
FIG. 3 is a schematic top view of the present invention.
Figure 4:
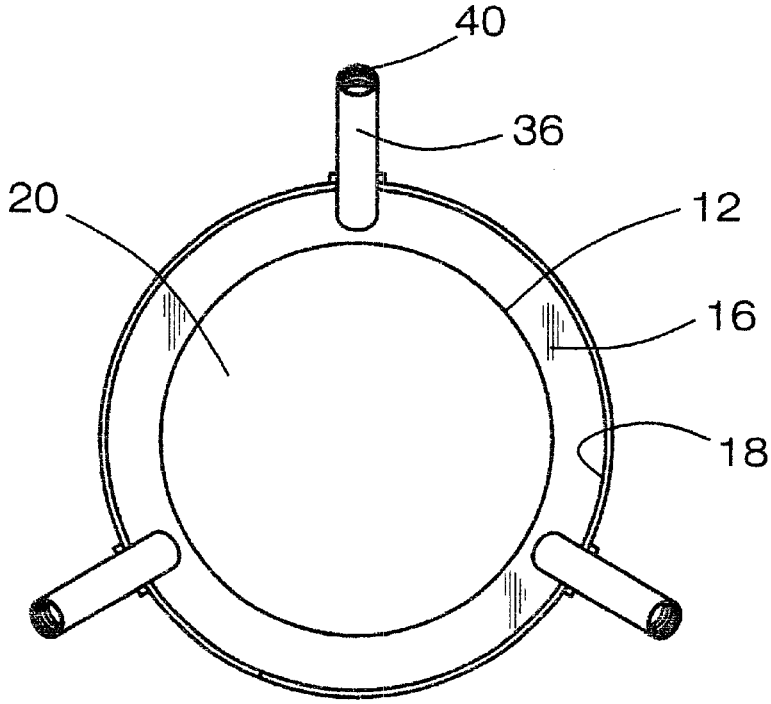
FIG. 4 is a schematic bottom view of the present invention.

With reference now to the drawings, and in particular to FIGS. 1 through 4 thereof, a new water cooler support device embodying the principles and concepts of the present invention and generally designated by the reference numeral 10 will be described.

As best illustrated in FIGS. 1 through 4, the water cooler support device 10 generally comprises a bottom support 12 having a top side 14, a bottom side 16 and a peripheral edge 18 extending between the top 14 and bottom 16 sides. The top side 14 has a generally circle shape. The bottom support 12 has an open central area 20. The top side 14 preferably has a diameter generally between 20 inches and 26 inches.

A plurality of elongate supports 22 has a first end 24 attached to the peripheral edge 18 of the bottom support 12 and each extends upwardly away from the bottom support 12. The elongate supports 22 are spaced from each other. The plurality of elongate supports 22 preferably includes three elongate supports.

An upper support 28 comprises an annular member attached to and extending between upper ends 26 of the elongate supports 22. The upper support 28 has a diameter generally equal to the diameter of the bottom support 12.

A peripheral lip 30 is integral to and extends upwardly from the peripheral edge 18 of the bottom support 12. The peripheral lip 30 has a notch 32 therein extending from an upper edge of the peripheral lip down to the bottom support 12 for receiving a nozzle 72 of a water cooler 70.

Each of a plurality of legs 34 is attached to and extends downward from the bottom side 16 of the bottom support 12. The legs 34 are spaced from each other. Each of the legs 34 is angled outwardly with respect to each other to give greater stability. Each of the legs 34 has a break therein such that a first portion 36 and a second portion 38 are defined. The first portions 36 are attached to the bottom support and each has a free end having a threaded hole 40 extending therein. Each of the second portions 38 has a first end having a threaded nub 42 thereon for threadably extending into and coupling to one of the holes 40. Each of the second ends of the second portions 38 has a foot 44 thereon. Preferably, the plurality of legs 34 is three legs.

In use, a conventional water cooler 70 is positioned on the top side 14 of the bottom support 12 so that the nozzle 72 is positioned in the notch 32. The legs 34 may be disassembled for easy storage and portability of the device.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A water cooler holding device for removably receiving a water cooler, the water cooler having a nozzle thereon for selectively releasing any contents of the water cooler, said device comprising:

a bottom support having a top side, a bottom side and a peripheral edge extending between said top and bottom sides, said top side having a generally circle shape, said bottom support having an open central area, said top side having a diameter generally between 20 inches and 26 inches;

a plurality of elongate supports having a first end attached to said peripheral edge of said bottom support and extending upwardly away from said bottom support, said elongate supports being spaced from each other, said plurality of elongate supports including three elongate supports;

an upper support comprising an annular member attached to and extending between upper ends of said elongate supports such that said upper support is spaced above from said bottom support for supporting an upper region of the water cooler, said upper support having a diameter generally equal to said diameter of said bottom support;

a peripheral lip being integral to and extending upwardly from said peripheral edge of said bottom support, said peripheral lip having a notch therein extending from an upper edge of said peripheral lip down to said bottom side for receiving the nozzle of the water cooler;

a plurality of legs being attached to and extending downward from said bottom side of said bottom support, said legs being spaced from each other, each of said legs being angled outwardly with respect to each other such that said legs diverge from each other from said bottom side of said bottom support toward lower ends of said legs, each of said legs having a break therein such that a first portion and a second portion are defined, each of said first portions being attached to said bottom support and having a free end having a threaded hole extending therein, each of said second portions having a first end having a threaded nub thereon for threadably extending into and coupling to one of said holes, each of said second ends of said second portions having a foot thereon, said plurality of legs being three legs; and wherein the water cooler is positioned on said top side of said bottom support.

* * * * *